US006814850B1

(12) United States Patent
Manz et al.

(10) Patent No.: US 6,814,850 B1
(45) Date of Patent: Nov. 9, 2004

(54) ACID BATH FOR ELECTRODEPOSITION OF GLOSSY GOLD AND GOLD ALLOY LAYERS AND A GLOSS ADDITIVE FOR SAME

(75) Inventors: Uwe Manz, Aalen (DE); Klaus Bronder, Schwäbisch Gmünd (DE)

(73) Assignee: Umicore Galvanotechnik GmbH, Hanau-Wolfgang (DE)

( * ) Notice: Subject to any disclaimer, the term of this patent is extended or adjusted under 35 U.S.C. 154(b) by 0 days.

(21) Appl. No.: 10/009,467

(22) PCT Filed: May 4, 2000

(86) PCT No.: PCT/EP00/03993

§ 371 (c)(1),
(2), (4) Date: Apr. 5, 2002

(87) PCT Pub. No.: WO00/79031

PCT Pub. Date: Dec. 28, 2000

(30) Foreign Application Priority Data

Jun. 17, 1999 (DE) ..... 199 27 642
Feb. 17, 2000 (DE) ..... 100 07 325

(51) Int. Cl.[7] ..... C25D 3/62; C25D 3/48; C23C 16/00

(52) U.S. Cl. ..... 205/247; 205/267; 106/1.23; 106/1.26

(58) Field of Search ..... 106/1.23, 1.26; 205/247, 267

(56) References Cited

U.S. PATENT DOCUMENTS

| | | | | |
|---|---|---|---|---|
| 3,929,595 A | 12/1975 | Biberbach et al. | ..... | 205/250 |
| 4,402,802 A | 9/1983 | Zilske et al. | | |
| 4,486,513 A | 12/1984 | Suzuki et al. | | |

FOREIGN PATENT DOCUMENTS

| | | | | |
|---|---|---|---|---|
| CH | 629258 * | 4/1982 | | |
| CH | 629258 a | 4/1982 | ..... | C25D/3/48 |
| DE | 23 55 581 A1 | 5/1975 | | |
| DE | 0 046 912 A1 | 3/1982 | | |
| DE | 4040526 A * | 6/1991 | ..... | C25D/3/48 |
| EP | 46912 A * | 3/1982 | ..... | C25D/3/48 |
| JP | 11050295 A2 | 2/1999 | | |

OTHER PUBLICATIONS

References N and O were cited on the European Search Report.*

Derwent, Chemical Abstract and EP Abstract for CH 629, 258 (Apr. 15, 1982).*

English Language Translation of PCT International Preliminary Examination Report (Form PCT/PEA/409) for International Application No. PCT/IEP00/03993, Sep. 24, 2001.

* cited by examiner

*Primary Examiner*—Edna Wong
(74) *Attorney, Agent, or Firm*—Kalow & Springut LLP

(57) ABSTRACT

The invention provides an acid bath for the electrodeposition of glossy gold and gold alloy layers and a gloss additive for same.

By using compounds of the formula I $$R—SO_m—H \quad (I)$$

in which m is the number 3 or 4 and

R represents a straight-chain or branched or cyclic alkyl group with up to 20 carbon atoms and, in the event that m=4, also an aryl or heteroaryl group with up to 10 carbon atoms, which may be optionally substituted once or several times with straight-chain or branched alkyl groups with 1 to 14 carbon atoms, as a further gloss additive, the current density/working range is extended with a small negative effect when the pH is changed and the current efficiency and deposition performance is increased.

11 Claims, No Drawings

ACID BATH FOR ELECTRODEPOSITION OF GLOSSY GOLD AND GOLD ALLOY LAYERS AND A GLOSS ADDITIVE FOR SAME

The invention provides an acid bath for the electrodeposition of glossy gold and gold alloy layers and a gloss additive for same.

Electroplating gold baths usually contain gold and optionally one or more alloy elements in dissolved form.

These types of electrolytes are mainly based on gold cyanide complexes. It is necessary to adjust these electrolytes to a weakly to moderately acid pH by using inorganic and/or organic acids and buffer salts.

So that glossy gold or gold alloy layers are deposited from such baths, these usually contain specific inorganic or organic compounds as so-called "gloss additives".

A typical, very frequently used gloss additive is, as described for example in DE 23 55 581, the compound pyridine-3-sulfonic acid.

These types of additive shift or extend the working range which can be used, that is the range of current densities within which a glossy gold coating is deposited, in the direction of higher current densities. There again, the use of higher current densities enables deposition to proceed at a greater rate.

On the other hand, the working range of these types of gold baths also depends on the pH of the electrolytes. This means that if the pH is higher the working range (current density range which can be used) becomes narrower, but at the same time the current efficiency, and thus the rate of deposition, is increased.

Therefore, the object of the invention was to optimise the working conditions and deposition performance in these types of gold baths in such a way that on the one hand a maximum current density/working range is produced with the smallest possible negative effect when the pH is changed and on the other hand a maximum current efficiency and rate of deposition is achieved.

Surprisingly, it has now been found that this can be achieved if at least one compound of the general formula I is added as a further gloss additive to these types of baths for deposition of glossy gold layers, $$R—SO_m—H \quad (I)$$

wherein m is the number 3 or 4, and

R represents a straight-chain or branched or cyclic alkyl group with up to 20 carbon atoms and, in the event that m=4, also an aryl or heteroaryl group with up to 10 carbon atoms, which may be optionally substituted once or several times with straight-chain or branched alkyl groups with 1 to 14 carbon atoms.

Thus, the invention provides an acid bath for the electrodeposition of glossy gold and gold alloy layers containing gold and optionally one or more alloy elements in dissolved form and also at least one organic compound as a gloss additive, characterised in that the bath contains, as a further gloss additive, at least one compound of the general formula $$R—SO_m—H \quad (I)$$

wherein m is the number 3 or 4, and

R represents a straight-chain or branched or cyclic alkyl group with up to 20 carbon atoms and, in the event that m=4, also an aryl or heteroaryl group with up to 10 carbon atoms, which may be optionally substituted once or several times with straight-chain or branched alkyl groups with 1 to 14 carbon atoms.

Gloss additives in accordance with formula I are chosen from the classes consisting of alkyl sulfonates and alkyl, aryl or heteroaryl sulfates. In formula I, if m is the number 3 or 4 then R represents a straight-chain or branched or cyclic alkyl group with up to 20 carbon atoms. If m is the number 4 than R may also represent an aryl or heteroaryl group with up to 10 carbon atoms, wherein these may be substituted once or several times with straight-chain or branched alkyl groups with 1 to 14 carbon atoms.

Compounds of the formula I are known per se and are either commercially available or can easily be prepared by standard processes.

These compounds are sufficiently soluble in water and are compatible with the electrodeposition bath. The compounds have surfactant properties, wherein the corresponding effect is reduced when the total number of carbon atoms is less than 4 and generally sufficient solubility is no longer exhibited when the total number of carbon atoms is greater than 20.

Preferred gloss additives are compounds of the formula I in which R represents straight-chain or branched or cyclic alkyl groups with 5 to 12 carbon atoms and in particular for branched alkyl groups with 6 to 10 carbon atoms.

Typical gloss additives according to the invention are

| | |
|---|---|
| pentyl sulfonate | pentyl sulfate |
| hexyl sulfonate | hexyl sulfate |
| heptyl sulfonate | heptyl sulfate |
| octyl sulfonate | octyl sulfate |
| nonyl sulfonate | nonyl sulfate |
| decyl sulfonate | decyl sulfate |
| dodecyl sulfonate | dodecyl sulfate |
| cyclohexyl sulfonate | cyclohexyl sulfate |

and their isomers.

These compounds may also be present in the form of their salts.

Branched and short-chain compounds are particularly suitable due to their low tendency to pronounced foam production, in particular in processes and plant in which severe foam production could cause problems, e.g. in the case of air-stirred electrolytes, when processing in drums, in plants for high-speed deposition (spray plants) and in plants for selective deposition such as e.g. dipping cells.

The use of the further gloss additive according to the invention in acid baths for the electrodeposition of glossy gold and gold alloy layers expediently takes place in the concentration range from 0.01 to 10 g/l. Baths according to the invention which contain the gloss additive in accordance with formula I at a concentration of 0.1 to 5 g/l are particularly advantageous.

Due to the use according to the invention of compounds of compounds (sic) of the formula I as a further gloss additive in electrodeposition gold baths with an otherwise conventional composition, the current density/working range which can be used is considerably extended in an unexpected manner and at the same time the current efficiency and the deposition performance are sometimes drastically increased.

To prepare gold baths according to the invention, many commonly used and commercially available weakly acidic gold baths may be used as the starting composition to which a corresponding amount of the compound of the formula I is added. The qualitative and quantitative composition of these types of gold baths is extremely well-known to a person skilled in the art from literature and from practice and therefore does not require a detailed explanation. In every case, these contain gold in dissolved form, obtained from gold salts or gold complex salts, wherein mainly gold cyanide complexes are used. Furthermore, the baths may contain alloy elements in the form of dissolved salts or complex salts. Furthermore, the baths contain inorganic and/or organic acids, corresponding salts and optionally buffer and supporting electrolytes in order to adjust the pH and the conductivity. In order to deposit glossy, smooth gold layers, organic compounds are generally contained therein, these mostly having surfactant properties and acting as a gloss-producer. A typical and well-proven gloss-producer of this type is pyridine-3-sulfonic acid.

Furthermore, the following compounds and their salts and derivatives are also suitable as conventional gloss additives:

nicotinic acid
nicotinamide
3-(3-pyridyl)-acrylic acid
3-(4-imidazolyl)-acrylic acid
3-pyridylhydroxymethanesulfonic acid
pyridine
picoline
quinolinesulfonic acid
3-aminopyridine
2,3-diaminopyridine
2,3-di-(2-pyridyl)-pyrazine
2-(pyridyl)-4-ethansulfonic acid
1-(3-sulfopropyl)-pyridinium betaine
1-(3-sulfopropyl)-isoquinolinium betaine Electrodeposition gold baths according to the invention typically contain about

- 0.1–50 g/l of gold as a gold cyanide complex
- 0–50 g/l of alloy elements such as iron, cobalt, nickel, indium, silver, copper, cadmium, tin, zinc, bismuth, arsenic, antimony as a salt or complex salt
- 10–200 g/l of citric acid/citrate as a buffer and/or supporting electrolyte
- 0.1–10 g/l of pyridine-3-sulfonic acid as gloss-producer
- 0.1–5 g/l of a compound of the formula I as a further gloss additive according to the invention, wherein the pH of the bath is adjusted to 3 to 6, preferably 4 to 5.

Use of the gloss additive according to the invention produces a number of practical advantages. Thus, under otherwise unchanged conditions, the deposition performance can be clearly increased. Due to the wider working range, fine adjustment of the mode of operation is less critical, wherein the risk of defective deposition is greatly reduced.

However, a higher pH may also be used with an unchanged working range. The deposition performance can also be increased in this way.

Alternatively, however, a smaller gold concentration may be used while retaining the same deposition performance. The advantages associated with this move are the smaller losses due to electrolytes being carried over by adhering to the goods and the smaller amount of capital which is tied up.

EXAMPLE 1

A working range of up to 3 A/dm$^2$ is produced with a cell current of 2 A in a coating cell which contains a gold/cobalt electrolyte containing

- 10 g/l of gold in the form of potassium gold(I) cyanide
- 0.5 g of cobalt as cobalt sulfate
- 100 g/l of citric acid
- 3 g/l of pyridine-3-sulfonic acid. adjusted to pH 4.2 with potassium hydroxide, (trial conditions: platinised titanium anode, temperature 50° C., time 2 min, agitated at 500 rpm with a 25 mm magnetic stirring rod). The current efficiency at 3 A/dm$^2$ is 48%; the rate of deposition is 0.98 $\mu$m/min.

By adding 1 g/l of nonyl sulfate, the maximum current density which can be used is increased to more than 5 A/dm$^2$. This corresponds to extending the working range by more than 66%.

If the pH is then raised to 4.4, a working range of up to 4 A/dm$^2$ is produced; the deposition performance is 1.05 $\mu$m/min.

At a pH of 4.6 the working range extends up to 3 A/dm$^2$ and a rate of deposition of 1.15 $\mu$m/min is produced.

EXAMPLE 2

A maximum current density of 3 A/dm$^2$ is achieved in a gold/nickel electrolyte containing

- 10 g/l of gold in the form of potassium gold(I) cyanide
- 0.7 g of nickel in the form of nickel sulfate
- 100 g/l of citric acid
- 3 g/l of pyridine-3-sulfonic acid, adjusted to pH 4.2 with potassium hydroxide, on pre-nickel-coated sheets with the dimensions 25×40 mm (trial conditions: 1 litre glass beaker, platinised titanium anode, bath agitated at 200 rpm using a 60 mm magnetic stirring rod, goods moved at 5 cm/s). The cathodic current efficiency at 3 A/dm$^2$ is 52% and the rate of deposition is 1.0 $\mu$m/min.

By adding 0.5 g/l of decyl sulfate, the maximum current density which can be used is increased to more than 7 A/dm$^2$. At 7 A/dm$^2$ the current efficiency is still 26%, the deposition performance increases to 1.18 $\mu$m/min. This corresponds to increasing the rate by 18%.

EXAMPLE 3

A maximum current density of 5 A/dm$^2$ is achieved in a gold/iron electrolyte containing

- 10 g/l of gold in the form of potassium gold(I) cyanide
- 0.05 g of iron as iron (III) citrate
- 100 g/l of citric acid
- 3 g/l of pyridine-3-sulfonic acid, adjusted to pH 4.2 with potassium hydroxide, on sheets with the dimensions 25×40 mm (for conditions, see example 2). The cathodic current efficiency is 31% and the rate of deposition is 1.0 $\mu$m/min.

By adding 4 g/l of hexyl sulfate the maximum current density which can be used is increased to more than 6 A/dm$^2$. At 6 A/dm$^2$ the current efficiency is still 30%; the deposition performance increases to 1.16 $\mu$m/min. This corresponds to increasing the rate by 16%.

EXAMPLE 4

A working range of up to 5 A/dm$^2$ is produced in a coating cell with a cell current of 2 A in a gold/cobalt electrolyte containing

- 10 g/l of gold in the form of potassium gold(I) cyanide
- 0.5 g of cobalt as cobalt sulfate
- 100 g/l of citric acid
- 1 g/l 3-(3-pyridyl)-acrylic acid, adjusted to pH 4.2 with potassium hydroxide, (trial conditions: platinised titanium anode, temperature 50° C., time 2 min, agitated at 500 rpm with a 25 mm magnetic stirring rod). The current efficiency at 5 A/dm$^2$ is 26%; the rate of deposition is 0.83 $\mu$m/min.

By adding 1.5 g/l of octyl sulfate the maximum current density which can be used is increased to more than 8

A/dm$^2$. At 8 A/dm$^2$ the current efficiency is still 19%; the deposition performance increases to 1.0 $\mu$m/min.

EXAMPLE 5

In the gold/cobalt electrolyte from example 1, the maximum current density which can be used is increased to more than 5 A/dm$^2$ by adding 1 g/l of hexyl sulfonate. At 5 A/dm$^2$ the current efficiency is 35.1%, the deposition performance is increased to 1.13 $\mu$m/min. This corresponds to increasing the rate by 15%.

EXAMPLE 6

In the gold/cobalt electrolyte from example 1, the maximum current density which can be used is increased to more than 7 A/dm$^2$ by adding 1 g/l of octyl sulfonate At 7 A/dm$^2$ the current efficiency is 26.2%, the deposition performance increases to 1.18 $\mu$m/min. This corresponds to increasing the rate by 20%.

EXAMPLE 7

Comparison Example

In a gold/cobalt electrolyte (see example 1) consisting of 10 g/l of gold in the form of potassium gold(I) cyanide 0.5 g of cobalt as cobalt sulfate 100 g/l of citric acid, adjusted to pH 4.2 with potassium hydroxide, and using the trial conditions in example 1, the effect on the working range and the rate of deposition was determined when adding only octyl sulfate, only pyridine-3-sulfonic acid and both substances together as a gloss additive. The results are given in table 1.

The combination of the two substances greatly extends the working range and causes a considerable increase in the rate of deposition.

TABLE 1

| Octyl sulfate | Pyridine-3-sulfonic acid | Working range (gloss) up to | Rate of deposition |
|---|---|---|---|
| — | — | 2 A/dm$^2$ | 0.63 $\mu$m/min |
| 2 g/l | — | 2 A/dm$^2$ | 0.65 $\mu$m/min |
| — | 3 g/l | 3 A/dm$^2$ | 0.98 $\mu$m/min |
| 2 g/l | 3 g/l | 5 A/dm$^2$ | 1.12 $\mu$m/min |

What is claimed is:

1. An electrodeposition bath for depositing glossy gold and gold alloy layers, comprising gold and at least one gloss additive selected from the group consisting of pyridine-3-sulfonic acid, nicotinic acid, nicotinic acid amide, 3-(3-pyridyl)-acrylic acid, 3-(4-imidazolyl)-acrylic acid, 3-pyridylhydroxymethanesulfonic acid, pyridine, picoline, quinolinesulfonic acid, 3-aminopyridine, 2,3-diaminopyridine, 2,3-di-(2-pyridyl)-pyrazine, 2-(pyridyl)-4-ethanesulfonic acid, 1-(3-sulfopropyl)-pyridinium betaine, 1-(3-sulfopropyl)-isoquinolinium betaine and salts or derivatives thereof, and an additional gloss additive, of the general formula $$R—SO_m—H \quad (I)$$

wherein m is the number 3 or 4, and when m is 3, R represents a straight-chain or branched or cyclic alkyl group with up to 20 carbon atoms, and when m is 4, R represents a straight-chain or branched or cyclic alkyl group with up to 20 carbon atoms or an aryl or heteroaryl group with up to 10 carbon atoms optionally substituted once or several times with straight-chain or branched alkyl groups with 1 to 14 carbon atoms.

2. An electrodeposition bath according to claim 1, wherein the additional gloss additive contains at least one compound of the general formula I in which R is a straight-chain or branched alkyl group with 5 to 12 carbon atoms.

3. An electrodeposition bath according to claim 1, wherein the additional gloss additive is selected from the group consisting of the compounds pentyl sulfonate, hexyl sulfonate, heptyl sulfonate, octyl sulfonate, nonyl sulfonate, decyl sulfonate, dodecyl sulfonate, cyclohexyl sulfonate, pentyl sulfate, hexyl sulfate, heptyl sulfate, octyl sulfate, nonyl sulfate, decyl sulfate, dodecyl sulfate, cyclohexyl sulfate or their isomers.

4. An electrodeposition bath according to claim 1, wherein at least one compound of the general formula I is present in an amount of 0.01 to 10 g/l.

5. An electrodeposition bath according to claim 1, wherein the bath further comprises one or more alloy elements in dissolved form.

6. An electrodeposition bath according to claim 1, wherein the additional gloss additive contains at least one compound of formula I where R is a branched alkyl group with 6 to 10 carbon atoms.

7. An electrodeposition bath according to claim 1, wherein at least one compound of general formula I is present in an amount of 0.1 to 5 g/l.

8. A process for electrodeposition of glossy gold and gold alloy layers, which comprises electrodepositing glossy gold and gold alloy layers using an electrodeposition bath containing gold and at least one gloss additive selected from the group consisting of pyridine-3-sulfonic acid, nicotinic acid, nicotinic acid amide, 3-(3-pyridyl)-acrylic acid, 3-(4-imidazolyl)-acrylic acid, 3-pyridylhydroxymethanesulfonic acid, pyridine, picoline, quinolinesulfonic acid, 3-aminopyridine, 2,3-diaminopyridine, 2,3-di-(2-pyridyl)-pyrazine, 2-(pyridyl)-4-ethanesulfonic acid, 1-(3-sulfopropyl)-pyridinium betaine, 1-(3-sulfopropyl)-isoquinolinium betaine and salts or derivatives thereof, and an additional gloss additive of the general formula $$R—SO_m—H \quad (I)$$

wherein m is the number 3 or 4, and when m is 3, R represents a straight-chain or branched or cyclic alkyl group with up to 20 carbon atoms, and when m is 4, R represents a straight-chain or branched or cyclic alkyl group with up to 20 carbon atoms or an aryl or heteroaryl group with up to 10 carbon atoms optionally substituted once or several times with straight-chain or branched alkyl groups with 1 to 14 carbon atoms.

9. A process for the electrodeposition of glossy gold and gold alloy layers according to claim 8, wherein the electrodeposition occurs at a pH in the range of 3 to 6.

10. A process for the electrodeposition of glossy gold and gold alloy layers according to claim 8, wherein the electrodeposition occurs at a pH in the range of 4 to 5.

11. A process for the electrodeposition of glossy gold and gold alloy layers according to claim 8, wherein the bath further comprises one or more alloy elements in dissolved form.

* * * * *